US010900296B2

(12) United States Patent
Shi

(10) Patent No.: US 10,900,296 B2
(45) Date of Patent: Jan. 26, 2021

(54) METHODS AND SYSTEMS FOR VIV SUPPRESSION UTILIZING RETRACTABLE FINS

(71) Applicant: CBM International, Inc., Houston, TX (US)

(72) Inventor: Shan Shi, Houston, TX (US)

(73) Assignee: CBM International, Inc., Houston, TX (US)

( * ) Notice: Subject to any disclaimer, the term of this patent is extended or adjusted under 35 U.S.C. 154(b) by 138 days.

(21) Appl. No.: 16/379,981

(22) Filed: Apr. 10, 2019

(65) Prior Publication Data

US 2019/0316423 A1 Oct. 17, 2019

Related U.S. Application Data

(60) Provisional application No. 62/656,130, filed on Apr. 11, 2018.

(51) Int. Cl.
*B63B 21/50* (2006.01)
*E21B 17/01* (2006.01)

(52) U.S. Cl.
CPC ..... *E21B 17/012* (2013.01); *B63B 21/502* (2013.01); *B63B 2021/504* (2013.01)

(58) Field of Classification Search
CPC ..... B63B 2021/504; B63B 21/663; E21B 17/012
See application file for complete search history.

(56) References Cited

U.S. PATENT DOCUMENTS 6,712,559 B2 * 3/2004 Lenormand ..... E21B 17/012 405/224.2
9,039,328 B2 * 5/2015 Melymuk ..... F16L 1/24 405/171
9,080,610 B1 * 7/2015 West ..... E02D 5/60
9,511,825 B1 * 12/2016 Henning ..... B63B 21/663
10,006,254 B2 * 6/2018 Shi ..... E21B 17/012
D847,211 S * 4/2019 Shi ..... D15/21
D861,736 S * 10/2019 Shi ..... D15/21
10,669,785 B1 * 6/2020 Allen ..... E21B 17/012
2002/0168232 A1 * 11/2002 Xu ..... E21B 17/01 405/224
2004/0051004 A1 * 3/2004 Bearman ..... F15D 1/12 244/130
2006/0153642 A1 * 7/2006 Esselbrugge ..... B63B 39/005 405/216
2007/0215028 A1 * 9/2007 Lie ..... F16L 1/123 114/243
2007/0231077 A1 * 10/2007 Burgess ..... F16L 1/123 405/216
2008/0236469 A1 * 10/2008 Masters ..... F16L 1/123 114/243
2010/0119308 A1 * 5/2010 Somerville ..... B63B 21/502 405/216
2010/0307762 A1 * 12/2010 Howard ..... E21B 17/012 166/350
2012/0168019 A1 * 7/2012 Allen ..... E21B 17/012 138/103

(Continued)

*Primary Examiner* — Benjamin F Fiorello
(74) *Attorney, Agent, or Firm* — Pierson IP, PLLC

(57) ABSTRACT

Embodiments disclosed herein describe cylindrical structures with indents configured to reduce vortex induced vibrations (VIV). For example, the cylindrical structures may be configured to reduce VIV for risers subject to ocean currents.

20 Claims, 8 Drawing Sheets

(56) References Cited

U.S. PATENT DOCUMENTS

| | | | | |
|---|---|---|---|---|
| 2015/0086276 | A1* | 3/2015 | Harbison | F15D 1/12 405/216 |
| 2016/0001336 | A1* | 1/2016 | Macquin | B08B 9/023 15/1.7 |
| 2016/0230475 | A1* | 8/2016 | Haddad | E21B 17/012 |
| 2017/0183917 | A1* | 6/2017 | Shi | E21B 17/012 |

* cited by examiner

METHODS AND SYSTEMS FOR VIV SUPPRESSION UTILIZING RETRACTABLE FINS

BACKGROUND INFORMATION

Field of the Disclosure

Examples of the present disclosure relate to retractable fins positioned within indents on a drilling riser buoyancy module or a submerged cylinder. More specifically, embodiments relate to fins that are configured to reduce vortex induced vibrations for submerged cylinders.

Background

Offshore drilling is a process where a wellbore is drilled below a seabed. When offshore drilling, a riser is utilized as an interface between the seabed and a surface vessel. Offshore drilling, production, and mining is more challenging than land-based due to remote and harsher environments, wherein components for offshore operation, the risers, are required to be submerged in water.

In conventional offshore platforms, risers are submerged in fluid. Some Risers are partially supported via buoyancy modules that reduce the load on the offshore platforms or surface vessels. As fluid currents pass by the outer surface of the buoyancy modules, vortices shed alternately from the sides of the riser buoyancy modules and travel downstream. This phenomenon is known as "Karman vortex street."

The frequency and magnitude of the vortex shedding is determined by the current's speed and the cross-sectional profile of the buoyancy modules. As a result of the vortex shedding, oscillating lift forces are produced. These lift forces are generally normal to the axis of the buoyancy modules and predominately in a cross-flow direction. This causes forced oscillations of the risers with buoyancy modules installed, known as vortex induced vibrations (VIV).

Conventional buoyancy modules include circular cross sections that are identical across a longitudinal axis of the cylindrical structures. Due to the identical cross sections, a spanwise correlation/coherence of vortex shedding is established. This produces in phase net lift forces having substantially large magnitudes. When vortex shedding frequency is close to a natural frequency of the riser, a resonant-vibration phenomenon known as "lock-in" occurs, which increases the amplitude of the vibrations.

Furthermore, conventional riser buoyancy modules have not adopted any VIV suppression devices, while other submerged cylindrical members such as risers use fairings, strakes, or fins to break the correlation of vortex shedding along the span of the structure, which diminishes the net lift force and VIV. The fairings, strakes, or fins protrude from the surface of the buoyancy modules. Thus the fairings, strakes, or fins cause larger drag forces from the flowing fluid on the submerged buoyancy modules. In addition these embodiments pose difficulties in operation, transporting, handling, and installing the structural system.

Accordingly, needs exist for effective systems and methods for buoyancy modules with retractable fins configured to reduce VIV.

SUMMARY

Embodiments disclosed herein describe cylindrical structures or buoyancy modules (referred to hereinafter collectively and individually as "cylindrical structures") with movable or retractable fins (referred to hereinafter individually and collectively as "retractable fins") positioned within indents, wherein the retractable fins are configured to reduce VIV. For example, the cylindrical structures may be configured to reduce VIV for risers subject to ocean currents.

Embodiments may include indents and retractable fins. In embodiments, the indents may be grooves within an outer surface of the cylindrical structures, wherein the indents include pairs of indents, alternating pairs notches positioned along an axis, and/or staggered indents. The paired indents may be symmetrical or asymmetrical, which may be continuous or staggered.

The retractable fins may be positioned within the indents. In embodiments, the retractable fins may be positioned within the indents, and have an axis of rotation that is aligned with the axis of the notches. In a first mode, the movable fins may be configured to be positioned within the indents such that an inner sidewall of the retractable fins is positioned adjacent to a sidewall of the notches. In a second mode, the retractable fins may rotate approximately ninety degrees and projection away from the indents. Based on the positioning of the retractable fins, the retractable fins may interact with changing ocean currents to reduce VIV applied to the cylindrical structures. In embodiments, the retractable fins may be configured to move between the first mode and the second mode based on a direction and force of the ocean currents.

In other embodiments, the retractable fins may be configured to be positioned within a tubing and in the first mode while being submerged in fluid. The tubing may be configured to secure the retractable fins in the first, retracted position by applying forces towards a central axis of the cylindrical structures. Responsive to removing the tubing and the corresponding forces towards the central axis of the cylindrical structures, the retractable fins may automatically move from the first mode to the second mode.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
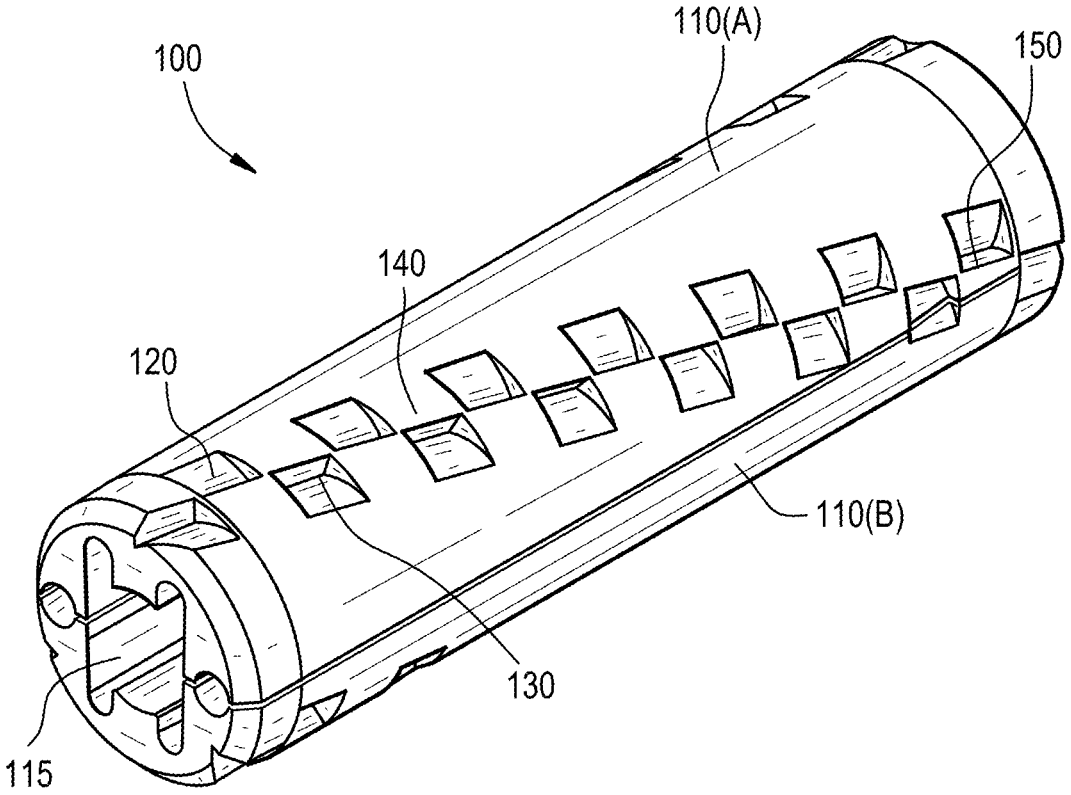
FIG. 1 depicts a cylindrical structure configured to be a riser buoyancy module, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments disclosed herein describe cylindrical structures with indents with retractable flaps configured to reduce VIV. In embodiments, the indents may be positioned within an outer surface of the cylindrical structures.

Turning now to FIG. 1, FIG. 1 depicts a cylindrical structure 100 configured to be a riser buoyancy module, according to an embodiment. A riser may be a conduit that is configured to provide a temporary extension of a subsea equipment to a surface facility. When used in water with a substantial depth, a riser should be tensioned to maintain stability. The level of tension required is related to the weight of the riser equipment, the buoyancy of the riser, the forces from waves and current, the weight of internal fluids, etc. To reduce the top hookload of the equipment on the surface, buoyancy modules are used to help maintain the required tension along the riser.

Cylindrical structure 100 may be a riser buoyancy module comprised of two halves 110(*a*) 110(*b*), pipe orifices 115, and indents 120, 130. Cylindrical structure 100 may be configured to be submerged in fluid, and minimize downtime caused by loop current VIV, which may increase operability of the surface facility.

The two halves 110(*a*) and 110(*b*) may be configured to encompass a riser pipe, wherein the riser pipe may be configured to be inserted into pipe orifices 115. The drilling riser pipe may be positioned within the cylindrical structure 100. The circumferences of two halves 110(*a*) and 110(*b*) may form a cylindrical outer surface. In embodiments, two halves 110(*a*) and 110(*b*) may be coupled together.

Cylindrical structure 100 may include a plurality of alternating V-shaped notches 120, 130 positioned on opposite sides of an axis 150, wherein the axis 150 extends from a first end of cylindrical structure 100 to a second end of cylindrical structure 100, which may cross both halves 110(*a*), 110(*b*). In embodiments, as shown in the cross sections, notches 120, 130 may be configured to reduce VIV considering the directional flow of the current and the positioning of notches 120, 130. In embodiments, the V-shaped notches 120, 130 may be offset such notches 120, 130 are positioned cattycorner from each other across axis 130, such that a first leg of notch 120 is positioned on a first side of axis 130, and a first leg of notch 130 is positioned on a second side of axis 130. Thus, the first legs of notches 120, 130 may create alternating continuous grooves from a first end of cylindrical structure 100 to a second end of cylindrical structure 100, wherein the grooves are not continuous on each side of axis 150 due to spacers 140.

In embodiments, a plurality of cylindrical structures 100 may be coupled together, wherein notches and axis on a first end of a first cylindrical structure 100 may be aligned with notches and axis on a second end of a second cylindrical structure 100. Accordingly, a drilling riser may include continuous, bidirectional, helical notches and axis extending from the first end of a riser to the second end of the riser.

Axis 150 may be a helical axis with a curve between the first and second ends of cylindrical structure 100. Each of the V-shaped notches 120, 130 may have a first leg and a second leg, wherein the V-shaped notches 120, 130 form square cutouts embedded within cylindrical structure 100. The first leg of the V-shaped notch may be a straight leg, and the second leg of the V-shaped notched may be curved, wherein the curvature of the second leg curves inward towards the longitudinal axis of cylindrical structure 100. Alternatively, the second leg of the V-shaped notches may be a straight leg.

Figure 2:
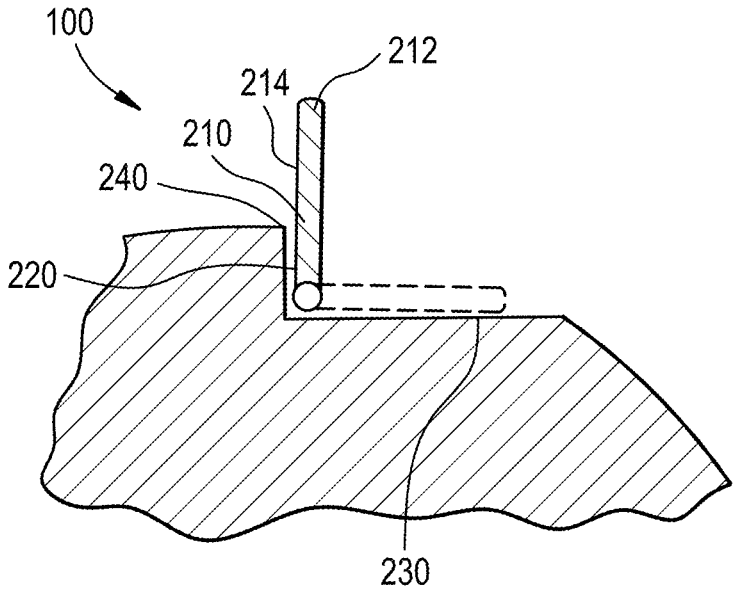
FIG. 2 depicts a cylindrical structure with embedded retractable fins, according to an embodiment.

FIG. 2 depicts a cylindrical structure 100 with embedded retractable fins 210, according to an embodiment. Elements depicted in FIG. 2 may be substantially the same as those discussed above. For the sake of brevity, a further description of these elements is omitted.

As depicted in FIG. 2, a movable fin 210 may be positioned within a notch 110, 120. Movable fin 210 may include an inner surface 212, outer surface 214, and hinge 220. Movable fin 210 may be configured to rotate between an open position and a closed position. In embodiments, the closed position may be a first mode, and the open position may be a second mode.

Inner surface 212 of retractable fin 210 may be configured to be positioned adjacent and flush against a second leg 230 of the notch in the first mode. In the second mode, inner surface 212 may be configured to be positioned away from second leg 230 of the notch.

Outer surface 214 of retractable fin 210 may be configured to be positioned adjacent and flush against a first leg 240 of the notch in the second mode. In the first mode, outer surface 214 may be configured to be positioned away from first leg 240. Furthermore, first leg 240 of the notch may limit the angle of rotation of movable fin 210, wherein first leg 240 may limit the angle to ninety degrees. In embodiments, first leg 240 may be configured to be positioned perpendicular to second leg 230.

Hinge 220 may be a mechanical bearing that is configured to couple retractable fin 210 within a notch of a cylindrical structure 100. Hinge 220 may be configured to allow retractable fin 210 to rotate between the first position and the second position. In embodiments, hinge 220 may be spring loaded such that hinge 220 applied force against retractable fin 210 to maintain retractable fin 210 in the opened position if outside forces are not applied to retractable fin 210.

When retractable fin 210 is in the first mode a body of retractable fin 210 may be positioned within the notch and a distal end of retractable fin 210 may not project past second leg 230. When retractable fin 210 is in the second mode, a proximal end of retractable fin 210 may be positioned within the notch and a distal end of retractable fin 210 may project away from the first leg 240 of notch. When retractable fin 210 projects away from first leg 240 the diameter of cylindrical body 100 may increase This may be due to the body of retractable fin 210 having a length that is shorter than a length of second leg 230 and longer than that of first leg 240, wherein the length of second leg 230 may be greater than first leg 240.

In embodiments, retractable fin 210 may be positioned in the first mode while retractable fin 210 is in a housing, such as a tube, and the housing limits the expansion of retractable fin 210. Responsive to removing the retractable fin 210 from the housing, the retractable fin 210 may automatically move from the first mode to the second mode due to the housing no longer limiting the expansion of retractable fin 210. Retractable fin 210 may remain in the second mode unless outside forces are applied against retractable fin 210 to move to back to the first mode.

Figure 3:
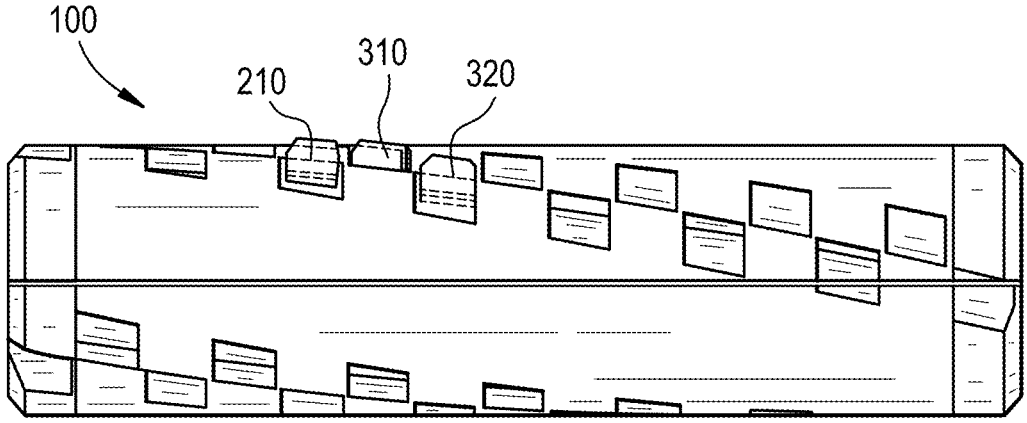
FIG. 3 depicts a cylindrical structure with a plurality of retractable fins, according to embodiment.

FIG. 3 depicts a cylindrical structure 100 with a plurality of retractable fins 210, 310, 320. Elements depicted in FIG. 3 may be described above, and for the sake of brevity a further description of these elements is omitted.

As depicted in FIG. 3, different retractable fins 210, 310, 320 may be positioned on the alternating notches on the different sides of axis 130. In embodiments, moveable fins 210, 320 on the same side of axis 130 may be configured to rotate in a first direction towards axis 130, and retractable fin 310 positioned on a different side of axis 130 may be configured to rotate in a second direction towards axis 130. By positioning movable fins 210, 310, 320 on different sides of axis 130 and at different positioning from a top to bottom of cylindrical structure 100 different fluid forces surrounding cylindrical structure 100 may impact each retractable fin 210, 310, 320 differently at different times. This may allow for greater reductions in vibrations.

Figure 4:
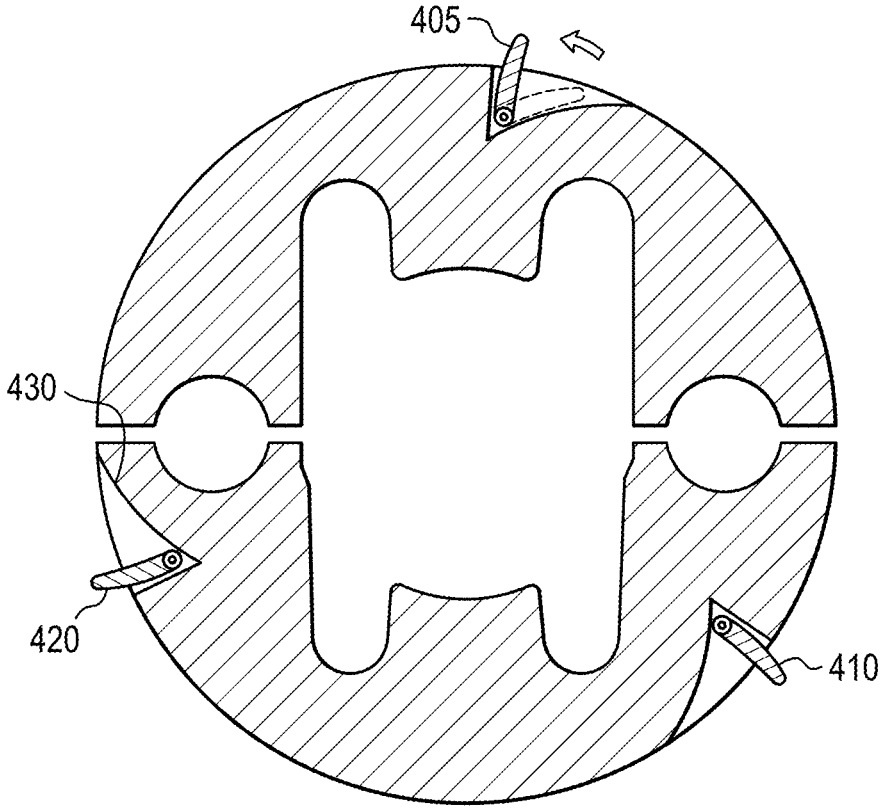
FIG. 4 depicts a cross section of cylindrical structure with a plurality of retractable fins, according to an embodiment.

FIG. 4 depicts a cross section of cylindrical structure 100 with a plurality of retractable fins 405, 410, 420. Elements depicted in FIG. 4 may be described above, and for the sake of brevity a further description of these elements is omitted.

As depicted in FIG. 4, a cross section of cylindrical structure 100 may have multiple retractable fins 405, 410, 420. Each of the retractable fins 405, 410, 420 may be vertically aligned with each other, such that each of the movable fins 405, 410, 420 corresponds with a different axis and/or pairs of notches.

As further depicted in FIG. 4, the notches 430 may be "V-Shaped" notches, which a convex curved leg or legs. Inner surfaces of retractable fins 405, 410, 420 may be similarly curved. The curvature of the notches 430 of movable fins 405, 410, 420 may allow flowing fluid to interact the fins and notches 430 more effectively. More specifically, as fluid is flowing around the cylindrical structure in an eddy, the curvature of the eddy may correspond more to the curvature of notches 430 than notches with a planar bottom surface, while increasing the amount of surface area that the flowing fluid impacts.

FIGS. 5-8 depict different variations of retractable fins, according to embodiments. Elements depicted in FIGS. 5-8 may be described above, and for the sake of brevity a further description of these elements is omitted.

Figure 5:
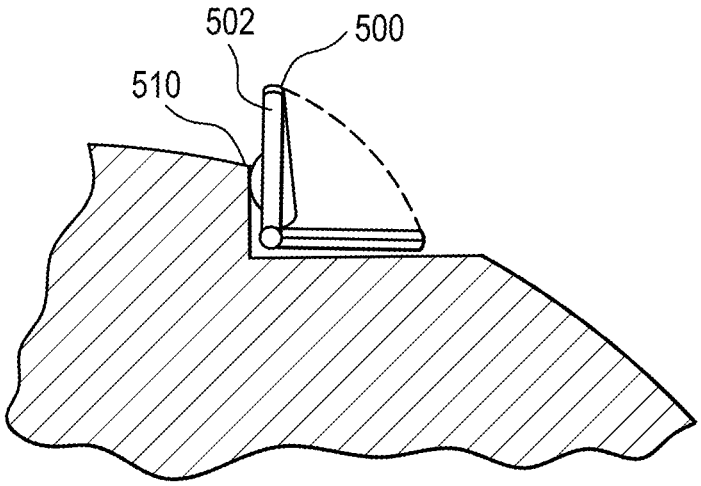
FIGS. 5-8 depict different variations of retractable fins, according to embodiments.

As depicted in FIG. 5, retractable fin 500 may include a stop 510 positioned on the outer surface 502 of retractable fin 500. Stop 510 may be comprised of a different material than moveable fin 500. For example, stop 510 may be comprised of a compressive rubber. Responsive to retractable fin 500 being in the second mode, stop 510 may be positioned adjacent to the first leg of a notch. This may be utilized to limit the erosion of retractable fin 500, and/or the legs of the cylindrical structures.

Figure 6:
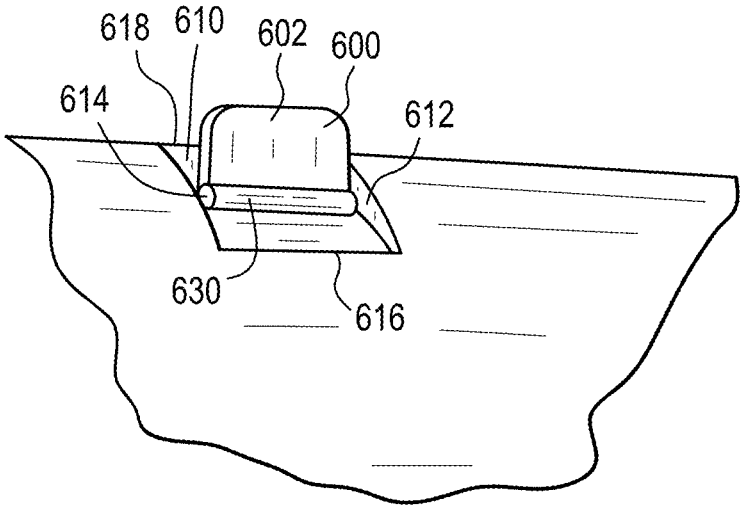

As depicted in FIG. 6, retractable fin 600 may be embedded within a notch that is substantially square shape 610. The square shape notches 610 may have two sidewalls 612, 614 that are configured to be encompassing the ends of retractable fin 600. The square shape notches 610 may have open ends 616, 618 that is not configured to obstruct the rotation of retractable fin 600, wherein a planar surface is positioned between the sidewalls 612, 614 and open ends 616, 618.

Further, when embedded within square shape notches 610, retractable fin 610 may be coupled to sidewalls 612, 614, via a hinge 630 that is positioned at a midway point within notch 610. Accordingly, in a first mode a distal end of 602 of retractable fin 600 may be positioned proximate to open end 616, in a second mode distal end 602 may be positioned proximate to open end 618, and in a third mode extend away from body 610 such that retractable fin 600 is positioned in a direction perpendicular to a central axis of the cylindrical structure and be positioned beyond the ends of sidewalls 612, 614. In embodiments, a distance between the midway point of notch 610 and the open ends 616, 618 may be less than a distance from a proximal end to distal end 602 of retractable fin 600, while the distance from the proximal end to the distal end 602 of retractable fin 600 may be greater than the height of sidewalls 612, 614.

Figure 7:
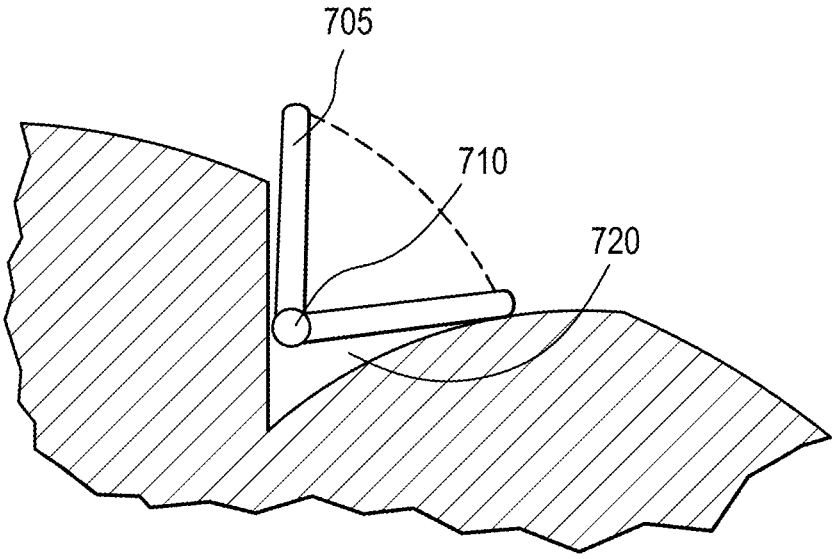

As depicted in FIG. 7, hinge 710 may be positioned along a sidewall of a leg of a notch 720, and not at an apex where the two legs of the notch 720 intersect. This may enable fin 705 to rotate ninety degrees even when notch 720 is a deep v-shaped with a curved leg.

Figure 8:
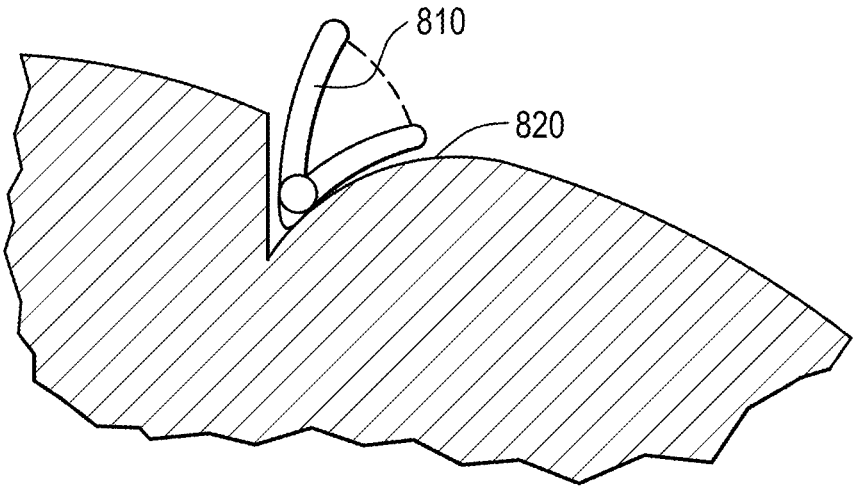

As depicted in FIG. 8, a curved fin 810 may be positioned within a deep-v notch 820, wherein at least one leg of notch 820 is curved. The curvature of fin 810 may allow fin 810 to be positioned adjacent to the curved leg 820 of notch 820 when fluid is not interacting with fin 810.

Figure 9:
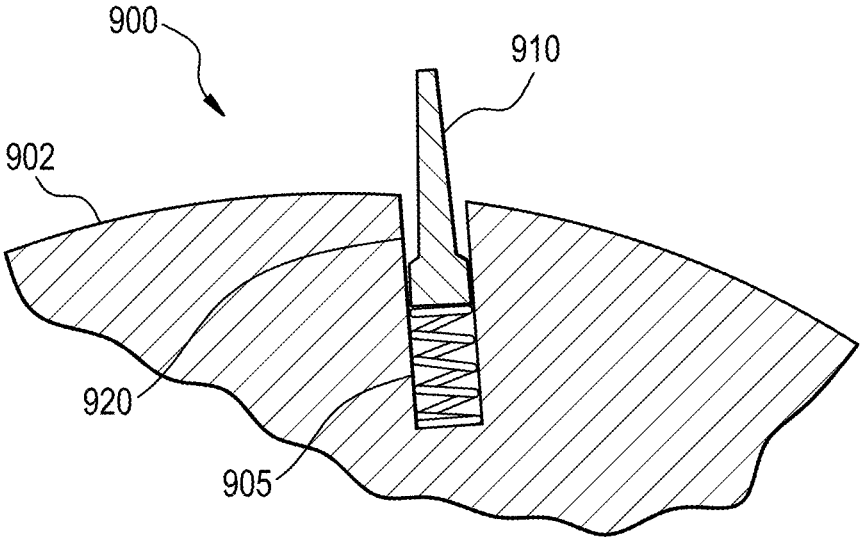
FIG. 9 depicts different variations of retractable fins, according to embodiment.

FIG. 9 depicts different variations of retractable fins, according to an embodiment. Elements depicted in FIG. 9 may be described above, and for the sake of brevity a further description of these elements is omitted.

As depicted in FIG. 9, cylindrical structure 902 may include a substantially rectangular notch 920 that extends towards the central axis of cylindrical structure 902. A spring 905 and retractable fin 910 may be configured to be housed within notch 920 when a force is applied against a distal end of retractable fin 910, such as when cylindrical structure is being inserted through tubing. The force applied against the distal end of fin 910 may be translated to spring 905 to compress spring 905.

Responsive to the tubing no longer applying pressure against the distal end of fin 910, spring 905 may elongate. This elongation of spring 905 may move distal end of fin 910 from a position flush with the outer surface of cylindrical structure 902 to a position away from the outer surface of cylindrical structure 902.

Figure 10:
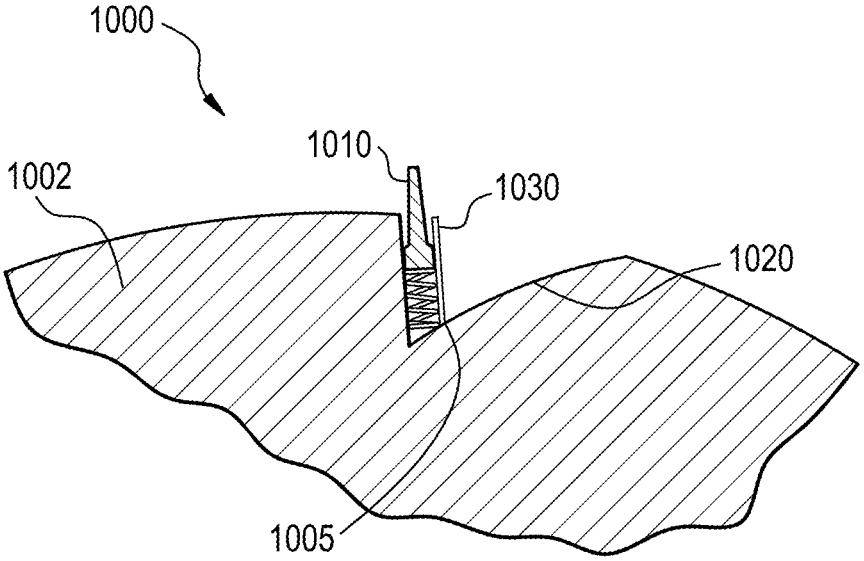
FIG. 10 depicts different variations of movable fins, according to embodiment.

FIG. 10 depicts different variations of movable fins, according to an embodiment. Elements depicted in FIG. 10 may be described above, and for the sake of brevity a further description of these elements is omitted.

As depicted in FIG. 10, a housing 1030 may be positioned within a deep-v notch 1020 with a curved leg. The housing 1030 may be positioned adjacent to a planar leg of notch 1020, and may extend from an apex of notch 1020 to the circumference of cylindrical structure 1002. Housing 1030 may be configured to store spring 1005 and moveable fin 1010. Spring 1005 and moveable fin 1010 may be configured to be positioned within housing 1030 when a force is applied against a distal end of movable fin 1010, such as when cylindrical structure 1002 is being inserted through tubing. The force applied against the distal end of fin 1010 may be translated to spring 1005 to compress spring 1005.

Responsive to the tubing no longer applying pressure against the distal end of fin 1010, spring 1005 may elongate. This elongation of spring 1005 may move distal end of fin 1010 from a position flush with the outer surface of cylindrical structure 1002 and housing 1030 to a position away from the outer surface of cylindrical structure 1030.

Figure 11:
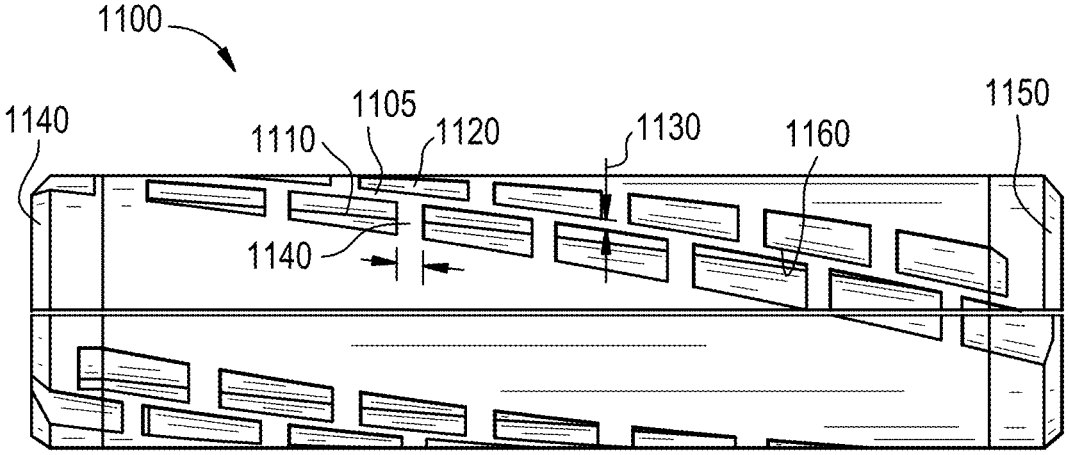
FIG. 11 depicts different variations of a cylindrical structure, according to embodiment.

FIG. 11 depicts different variations of a cylindrical structure 1100, according to an embodiment. Elements depicted in FIG. 11 may be described above, and for the sake of brevity a further description of these elements is omitted.

As depicted in FIG. 11, cylindrical structure 1100 may include overlapping notches 1110 and 1120, wherein each of the notches is different sized and shaped. More specifically, notches positioned closer to a first end 1140 of cylindrical structure 1100 may be shorter and have a smaller width than notches positioned closer to a second end 1140 of cylindrical structure 1100.

The notches on cylindrical structure 1100 may overlap, such that the ends of a first notch positioned on a first side of axis 1160 are aligned with two different notches on a second side of axis 1160. Furthermore, due to the varying sizes of the notches on cylindrical structure 1100 there may be a varying distance between notches on the same side of axis 1160. Additionally, there may be a varying distance between notches on a first side of axis 1160 and notches on a second side of axis 1160. The varying distances in multiple dimensions may allow fluid flowing around cylindrical structure 1100 to each impact each notch different. This may allow for more efficient and effective reducing of vibrations. Furthermore, embodiments may include retractable fins that have different lengths and widths that are configured to correspond to the varying sizes of the notches with different sizes. This may enable each of the retractable fins to impact the VIV dampening differently.

Figure 12:
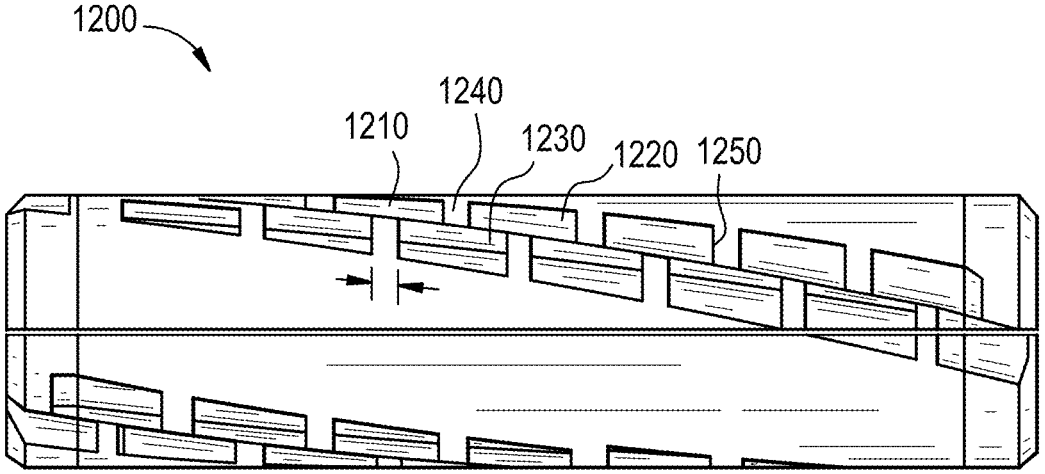
FIGS. 12-13 depict different variations of a cylindrical structure, according to embodiment.
Figure 13:
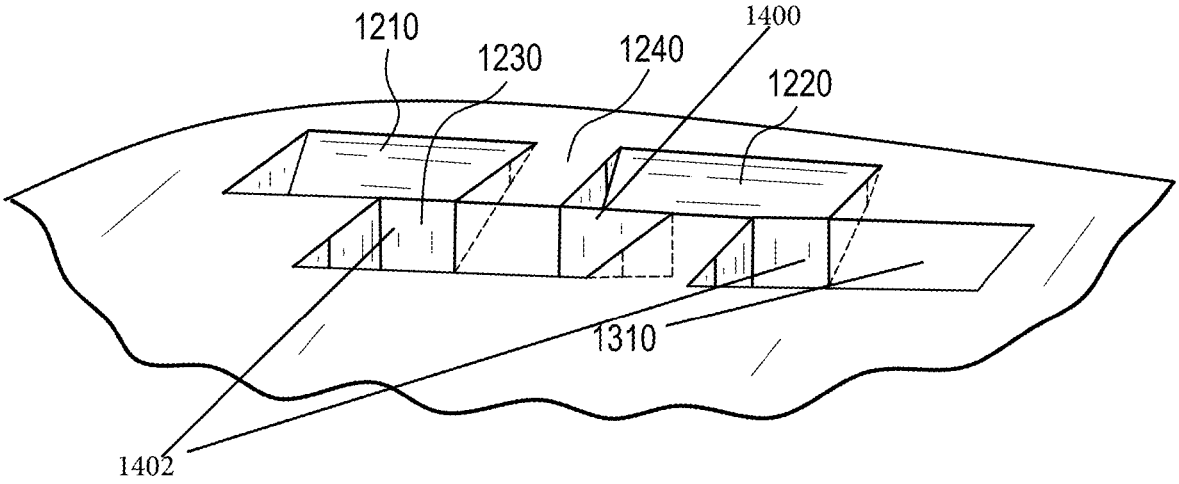

FIGS. 12-13 depict different variations of a cylindrical structure 1200, according to embodiments. Elements depicted in FIGS. 12-13 may be described above, and for the sake of brevity a further description of these elements is omitted.

As depicted in FIG. 12, notches 1210, 1220, 1230 may overlap adjacent notches. Accordingly, ends of the notches positioned on a first side of axis 1250 may be aligned with different notches positioned on the second side of axis 1250. In embodiments, the ends of the notches on a first side of axis 1250 may be configured to overlap with different notches positioned on the second side of axis 1250. This may create series of overlapping notches. Furthermore, the notches may be directly adjacent to axis 1250, such that the notches positioned on different sides of axis 1250 are adjacent to each other.

The notches may vary in size and spacing from the first end of cylindrical structure 1200 to a second end of cylindrical structure 1200. This may cause spaces 1240 between adjacent notches on the same side of axis 1250 to be different.

As depicted in FIG. 13, notches 1210, 1220 positioned on the same side of axis 1250 may have spacer 1240 positioned between them, wherein spacer 1240 has a curved sidewall.

The sidewalls of spacer 1240 may be aligned the ends of notches 1210, 1220 positioned on the same side of axis 1250. Further, spacer 1240 may have a sidewall that is aligned with a sidewall of notch 1310 positioned on a second side of axis 1250. A similar spacer may be positioned between notches on the other side of axis 1250 of notch 1230.

Furthermore, as notches 1210 and 1310 and 1220 overlap, there may be a passageway, void, etc. positioned between the two that extend across axis 1250. This passageway may allow for communication of fluid between the notches on different sides of axis 1250.

Figure 14A:
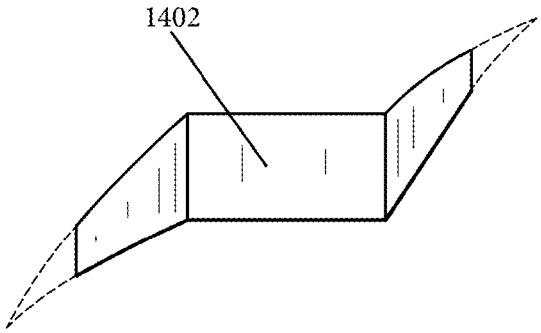
FIG. 14A and FIG. 14B depict different variations of a gap bracket, according to embodiment.
Figure 14B:
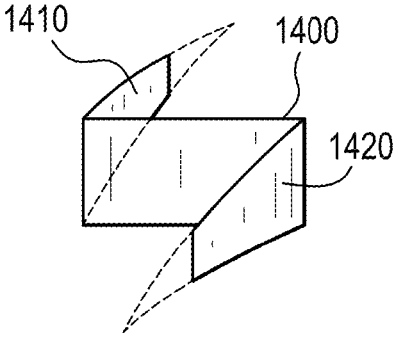

FIGS. 14A and B depict different variations of a gap bracket 1400 1402, according to embodiments. Elements depicted in FIGS. 14A and 14B may be described above, and for the sake of brevity a further description of these elements is omitted.

Gap bracket 1400 may be configured to be inserted into a notch 1210, 1220, 1230 and across a passageway between the notches to limit the exposed cutouts of notches 1210, 1220, 1230. Gap bracket 1400, 1402 may be a replaceable device that is configured to divert the fluid flowing around cylinder 1200. The gap brackets 1400, 1402 may be utilized to vary the impact and vibrations caused by fluid flowing around cylinder 1200. As such, each cylinder 1200 may have a different layout. Further, due to gap bracket 1400, 1402 being replaceable, if gap bracket 1400, 1402 is eroded, a new gap bracket 1400, 1402 may be inserted.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A cylindrical structure configured to reduce vortex induced vibrations comprising:

a notch positioned within the cylindrical structure;

a fin configured to rotate within the notch, the fin including a first surface and a second surface, wherein in a first mode the first surface is positioned against a first sidewall of the notch, and in a second mode the first surface is positioned away from the first surface of the notch.

2. The cylindrical structure of claim 1, wherein the notch includes a second sidewall, and a length of the fin is shorter than the first sidewall and longer than the second sidewall.

3. The cylindrical structure of claim 2, wherein the first sidewall and the second sidewall are curved.

4. The cylindrical structure of claim 1, further comprising:

a hinge configured to apply forces in a first direction to the fin to rotate the fin from the first mode to the second mode.

5. The cylindrical structure of claim 4, wherein compressive forces are applied to the fin in a second direction to maintain the fin in the first mode.

6. The cylindrical structure of claim 4, wherein the hinge is positioned proximate to an intersection of the first sidewall and the second sidewall.

7. The cylindrical structure of claim 1, further comprising:

an axis extending from a first end of the cylindrical structure to a second end of the cylindrical structure;

a first plurality of notches positioned on a first side of the axis;

a first plurality of fins positioned within the first plurality of notches, each of the first plurality of fins being configured to rotate in a first direction towards the axis to transition from the first mode to the second mode.

8. The cylindrical structure of claim 7, further comprising:

a second plurality of notches positioned on a second side of the axis;

a second plurality of fins positioned within the second plurality of notches, each of the second plurality of fins being configured to rotate in a second direction towards the axis to transition from the first mode to the second mode, wherein the first direction and second direction are opposite directions.

9. The cylindrical structure of claim 1, further including:

a plurality of overlapping notches including the notch, wherein each of the plurality overlapping notches is different sized and shaped.

10. The method of claim 9, wherein each of the plurality of overlapping notches has a different spacing from adjacent notches.

11. A method for using cylindrical structure configured to reduce vortex induced vibrations comprising:

positioning a fin within a notch in the cylindrical structure;

positioning a first surface of the fin against a first sidewall of the notch in a first mode;

rotating the fin within the notch;

positioning the first surface away from the first sidewall of the notch in a second mode.

12. The method of claim 11, wherein the notch includes a second sidewall, and a length of the fin is shorter than the first sidewall and longer than the second sidewall.

13. The method of claim 12, wherein the first sidewall and the second sidewall are curved.

14. The method of claim 11, further comprising:

rotating the fin from the first mode to the second mode by a hinge applying forces against the fin in a first direction.

15. The method of claim 14, further comprising:

applying compressive forces against the fin in a second direction to maintain the fin in the first mode.

16. The method of claim 14, wherein the hinge is positioned proximate to an intersection of the first sidewall and the second sidewall.

17. The method of claim 11, further comprising:

positioning a first plurality of notches on a first side of an axis, the axis extending from a first end of the cylindrical structure to a second end of the cylindrical structure;

positioning a first plurality of fins within the first plurality of notches, each of the first plurality of fins being configured to rotate in a first direction towards the axis to transition from the first mode to the second mode.

18. The method of claim 17, further comprising:

positioning a second plurality of notches on a second side of the axis;

positioning a second plurality of fins within the second plurality of notches, each of the second plurality of fins being configured to rotate in a second direction towards the axis to transition from the first mode to the second mode, wherein the first direction and second direction are opposite directions.

19. The method of claim 11, wherein the cylindrical structure includes a plurality of overlapping notches including the notch, wherein each of the plurality overlapping notches is different sized and shaped.

20. The method of claim 19, wherein each of the plurality of overlapping notches has a different spacing from adjacent notches.

* * * * *